US009240175B1

(12) United States Patent
Wyche

(10) Patent No.: US 9,240,175 B1
(45) Date of Patent: Jan. 19, 2016

(54) BELL WITH LOCKABLE KNOCKER

(71) Applicant: Christopher Wyche, Newbury Park, CA (US)

(72) Inventor: Christopher Wyche, Newbury Park, CA (US)

( * ) Notice: Subject to any disclaimer, the term of this patent is extended or adjusted under 35 U.S.C. 154(b) by 231 days.

(21) Appl. No.: 14/152,194

(22) Filed: Jan. 10, 2014

Related U.S. Application Data

(60) Provisional application No. 61/761,933, filed on Feb. 7, 2013.

(51) Int. Cl.

| | |
|---|---|
| ***G10K 1/10*** | (2006.01) |
| *G10K 1/07* | (2006.01) |
| *G10K 1/00* | (2006.01) |
| *G10K 1/06* | (2006.01) |
| *G10K 1/071* | (2006.01) |
| *G10K 1/072* | (2006.01) |
| *G10K 1/32* | (2006.01) |

(52) U.S. Cl.
CPC .. *G10K 1/10* (2013.01); *G10K 1/00* (2013.01); *G10K 1/06* (2013.01); *G10K 1/07* (2013.01); *G10K 1/071* (2013.01); *G10K 1/072* (2013.01); *G10K 1/32* (2013.01)

(58) Field of Classification Search
CPC ..... G10K 1/00; G10K 1/06; G10K 1/07; G10K 1/071; G10K 1/072; G10K 1/32; G10K 1/10
USPC ..... 116/148–150, 155–172, 25; 84/404, 84/406, 407; 446/418–422
See application file for complete search history.

(56) References Cited

U.S. PATENT DOCUMENTS

| | | | | | |
|---|---|---|---|---|---|
| 116,241 | A * | 6/1871 | Volger | G10K 1/071 | 116/171 |
| 122,397 | A * | 1/1872 | Meneely | G10K 1/072 | 116/167 |
| 513,152 | A * | 1/1894 | Smith | G10K 1/072 | 116/167 |
| 581,780 | A * | 5/1897 | Shaber | G10K 1/0645 | 116/148 |
| 1,349,694 | A * | 8/1920 | Alexander | G08B 13/08 | 116/75 |
| 1,848,020 | A * | 3/1932 | Merrill | G10K 1/32 | 116/150 |
| 2,818,829 | A * | 1/1958 | Hendricks | G10K 1/071 | 116/171 |
| 3,769,870 | A * | 11/1973 | Huber | G10K 1/341 | 116/167 |
| 3,910,225 | A * | 10/1975 | Huber | G10K 1/341 | 116/167 |
| 4,566,400 | A * | 1/1986 | Keenan | G10K 1/072 | 116/149 |
| 6,739,282 | B1 * | 5/2004 | Yuan | G10K 1/071 | 116/148 |
| 6,871,613 | B2 * | 3/2005 | Murray | G10K 1/08 | 116/148 |
| 6,945,677 | B2 * | 9/2005 | Fu | B62J 3/00 | 340/432 |
| 7,220,904 | B2 * | 5/2007 | Rom | G10K 1/08 | 84/402 |
| 7,777,109 | B2 * | 8/2010 | Saragosa | G10D 13/06 | 84/302 |
| 8,669,450 | B2 * | 3/2014 | Mohr | B05D 1/18 | 84/406 |
| 2006/0281388 | A1 * | 12/2006 | Quarles | A01M 31/004 | 446/418 |
| 2009/0253340 | A1 * | 10/2009 | Lee | G10K 11/08 | 446/81 |
| 2011/0201248 | A1 * | 8/2011 | Bean | A01M 31/004 | 446/418 |

* cited by examiner

*Primary Examiner* — R. A. Smith
*Assistant Examiner* — Tania Courson
(74) *Attorney, Agent, or Firm* — Sandy Lipkin

(57) ABSTRACT

A device and method is disclosed that provides an alerting bell that can be quickly and easily disabled when desired. The bell includes a knocker portion inside a cylindrical body that is spring loaded so that it can be pulled below the bottom rim of the cylindrical body of the bell. The knocker portion and the bottom rim of the bell are modified so that the bottom portion of the knocker portion can be securely affixed to the rim of the cylindrical main body as needed to turn off the alerting function of the bell as desired.

8 Claims, 5 Drawing Sheets

BELL WITH LOCKABLE KNOCKER

REFERENCE TO PRIOR APPLICATION

This application claims priority of the provisional patent application 61/761,933, filed Feb. 7, 2013 entitled BELL WITH LOCKABLE KNOCKER by Christopher Wyche.

BACKGROUND OF THE INVENTION

1. Field of the Invention

The field of this invention relates generally to the field of alerting bells, and more specifically toward a bell whose alerting function can be quickly and easily disabled when necessary.

2. Description of the Prior Art

While mountain biking, it is a matter of safety to alert others using a trail when the mountain biker is descending. Because of the high speed of the descending bicycle, there is the possibility of collision with other users on the trial if they are not aware of the speeding bicycle's presence. Such collisions can occur with other bicycles, hikers or horseback riders. Horses can also be spooked by the sudden appearance of a quickly descending bicycle.

To act as an alert, prior art methods have included the use of bells. The first type of bell is the sort that can be activated by the movement of a trigger from one side to the other to make a single sound. Alternatively, a bell with a knocker has also been used.

There are limitations with these prior art methods, however. The first type of bell requires the cyclist to remove his hand from the handle bars to make repeated sounds as only one sound is made with one movement of the trigger. There are limitations to the alert made and there is the safety issue of the prolonged removal of the cyclist's hands from the handlebars.

For a more old fashioned bell, the problem is that there is no real way to stop it from ringing when you don't want it to, such as on the incline up a trail.

It is the object of the present invention to provide a bell to alert others on a trail that overcomes the limitations of the prior art.

SUMMARY OF THE INVENTION

The basic embodiment of the present invention teaches a sound alerting device comprising: a main body substantially cylindrical in shape having a closed top, said closed top having a top and a bottom, an open bottom with a rim perimeter defined thereby and a hollow center portion; an elongated member having a first end and a second end, said first end being attached to said bottom of said closed top whereby said elongated member moves freely in said interior space and whereby said elongated member is spring loaded thereby allowing said elongated member to extend below said rim perimeter of said open bottom; a knocking portion of said elongated member attached to said second end of said elongated member wherein when said knocking portion strikes said main body a sound is made and wherein said knocking portion further comprises: a substantially disc shaped body having a radial perimeter wherein said radial perimeter contains one or more grooves that are attachable to said rim perimeter of said open bottom of said main body as desired thereby disabling the ability of said knocking portion to make a sound.

The above embodiment can be further modified by defining that said rim perimeter of said main body includes a series of substantially evenly spaced grooves.

The above embodiment can be further modified by defining that said radial perimeter of said disc shaped body includes a series of substantially evenly shaped posts whereby said posts fit into said evenly spaced grooves on said rim perimeter of said main body.

The above embodiment can be further modified by defining that a loop is attached to said top of said closed top thereby allowing said sound alerting device to be attached to another article.

A second embodiment teaches a method for disabling a sound alerting device comprising: providing a disable-able sound alerting device, said sound alerting device further comprising: a main body substantially cylindrical in shape having a closed top, said closed top having a top and a bottom, an open bottom with a rim perimeter defined thereby and a hollow center portion; an elongated member having a first end and a second end, said first end being attached to said bottom of said closed top whereby said elongated member moves freely in said interior space and whereby said elongated member is spring loaded thereby allowing said elongated member to extend below said rim perimeter of said open bottom; a knocking portion of said elongated member attached to said second end of said elongated member wherein when said knocking portion strikes said main body a sound is made and wherein said knocking portion further comprises: a substantially disc shaped body having a radial perimeter wherein said radial perimeter contains one or more grooves that are attachable to said rim perimeter of said open bottom of said main body as desired thereby disabling the ability of said knocking portion to make a sound; pulling said elongated member below said rim perimeter of said open bottom; and affixing said disc shaped body to said rim perimeter of said open bottom through the mating of said grooves with said rim perimeter of said open bottom.

The above embodiment can be further modified by defining that said rim perimeter of said main body includes a series of substantially evenly spaced grooves.

The above embodiment can be further modified by defining that said radial perimeter of said disc shaped body includes a series of substantially evenly shaped posts whereby said posts fit into said evenly spaced grooves on said rim perimeter of said main body.

The above embodiment can be further modified by defining that a loop is attached to said top of said closed top thereby allowing said sound alerting device to be attached to another article.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
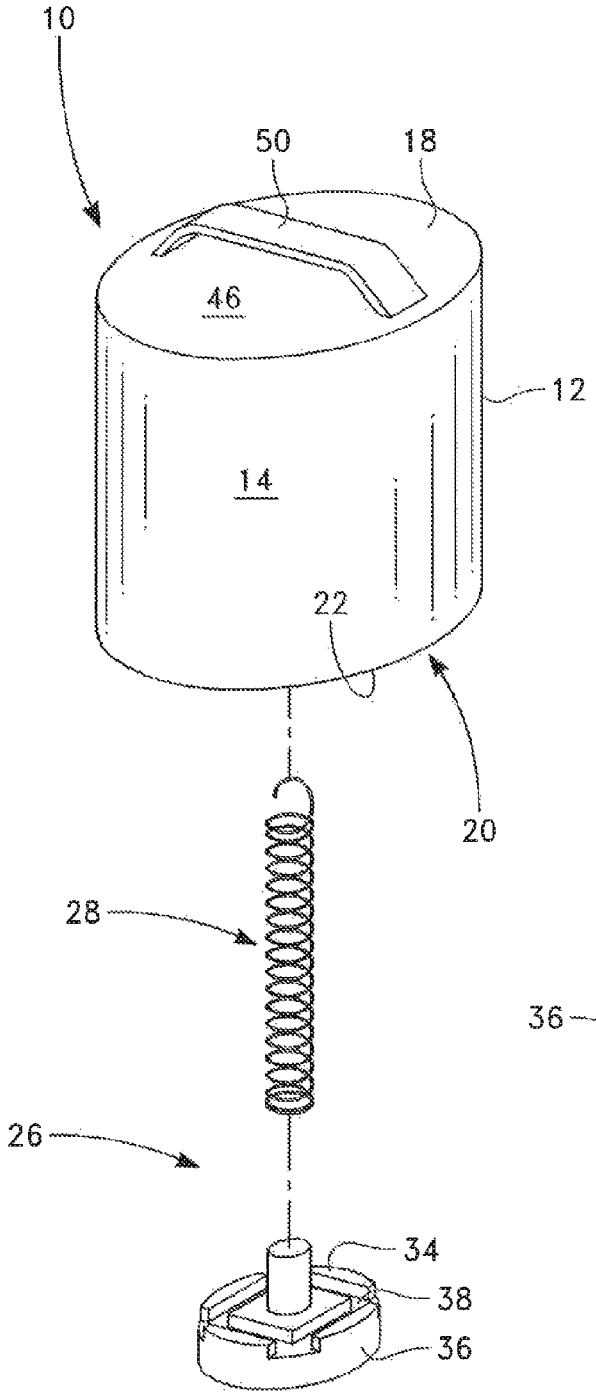
FIG. 1 is an exploded view of the preferred embodiment of the alerting bell of the instant invention.

Turning to the drawings, the preferred embodiment is illustrated and described by reference characters that denote similar elements throughout the several views of the instant invention.

The preferred embodiment is a bell 10 that can be adapted to hang on a bicycle or the rider or something the rider or bicycle is carrying, such as a pack. The bell 10 includes a hollow body 12 that is substantially cylindrical in shape has an outer wall 14 and an inner wall 16. The hollow body 12 has a closed top 18 and an open bottom 20. The open bottom 20 is defined by a rim 22 that runs the perimeter of the hollow body 12. The interior portion 24 houses a hanging knocker 26. The knocker 26 is spring loaded 28 allowing the knocker 26 to be stretched. It is contemplated that any means of allowing the hanging knocker to be manually stretched can be employed. The knocker 26 is attached to the bottom 30 of the closed top 18 through a flange 32 that allows the knocker 26 to freely move throughout the interior portion 24 and to strike the interior wall 16 of the hollow body 12 thereby making an alerting sound. The end 34 of the knocker 26 that is not attached to the closed top 18 contains a knocking portion 36 that strikes the interior wall 16 of the hollow body 12.

The hollow body 12 and knocking portion 36 are made of a material, such as stainless steel, that makes a loud clanging sound when contact is made between the two.

The knocker 26 is attached to the inside of the main body 12 by a spring 28 that allows the knocker 26 to be pulled downward. In the preferred embodiment, the knocking portion 36 has one or more retention grooves 38 as seen in FIGS. 1-7B. Alternatively, as seen in FIG. 5, the knocking portion 36A has a series of posts 38A rather than grooves for attachment to the perimeter 22. In yet another alternate embodiment as seen in FIG. 8, the knocking portion 36B can include one or more grooves 42 that attach to a modified rim 22A that includes a series of flanges 40 substantially evenly distributed throughout the perimeter creating a space for the grooves 42 to fit to secure into place. It is contemplated that any mating male/female fittings can be used on the knocking portion and rim respectively that allows the knocking portion to securely fit into the rim.

To activate, the user pulls the knocker 26 down away from the closed top 18 of the interior portion 24 of the main body 12 through the use of the spring 28 allowing the knocker 26 to extend beyond the bottom rim 22 of the main body 12. The rim 22 in the preferred embodiment is smooth and provides flange positions wherever desired that lock into the grooved portions 38 of the knocking portion 36. In the inverse embodiment shown in FIG. 8, the knocking portion 36 contains a series of flanges 40 that lock into one or more grooves 42 found on the bottom rim 22 of the main body 12. In either embodiment, the knocking portion 36 is then pulled towards the bottom rim 22 of the main body 12 and held in place by one or more of the retention grooves 38, 42 found either on the knocking portion 36 or the rim 22 of the main body 12.

Figure 2:
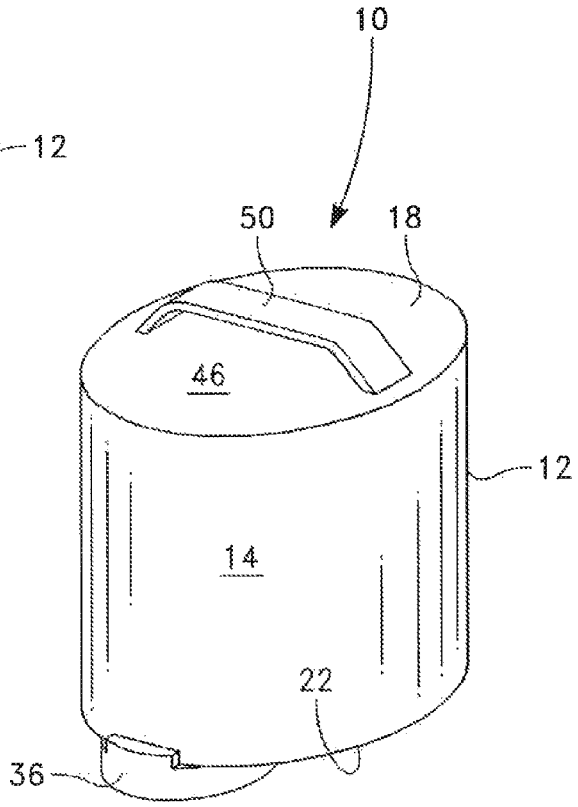
FIG. 2 is a perspective view of the preferred embodiment of the alerting bell of the instant invention in the locked and disabled position.
Figure 3:
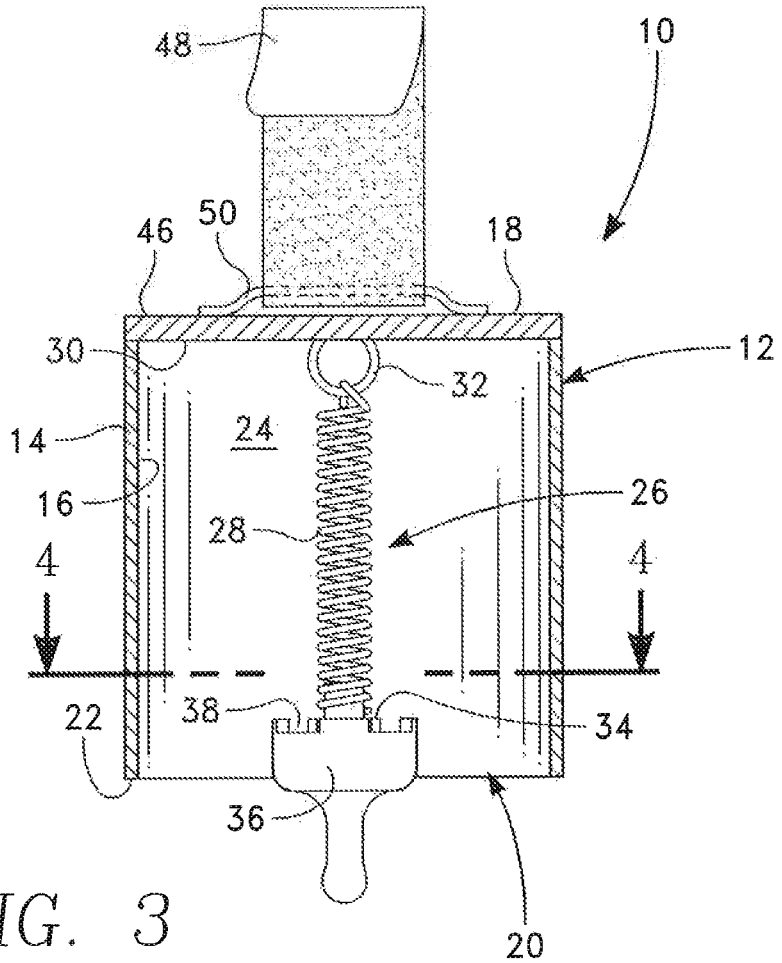
FIG. 3 is a cross sectional side view of the preferred embodiment of the alerting bell of the instant invention.
Figure 7B:
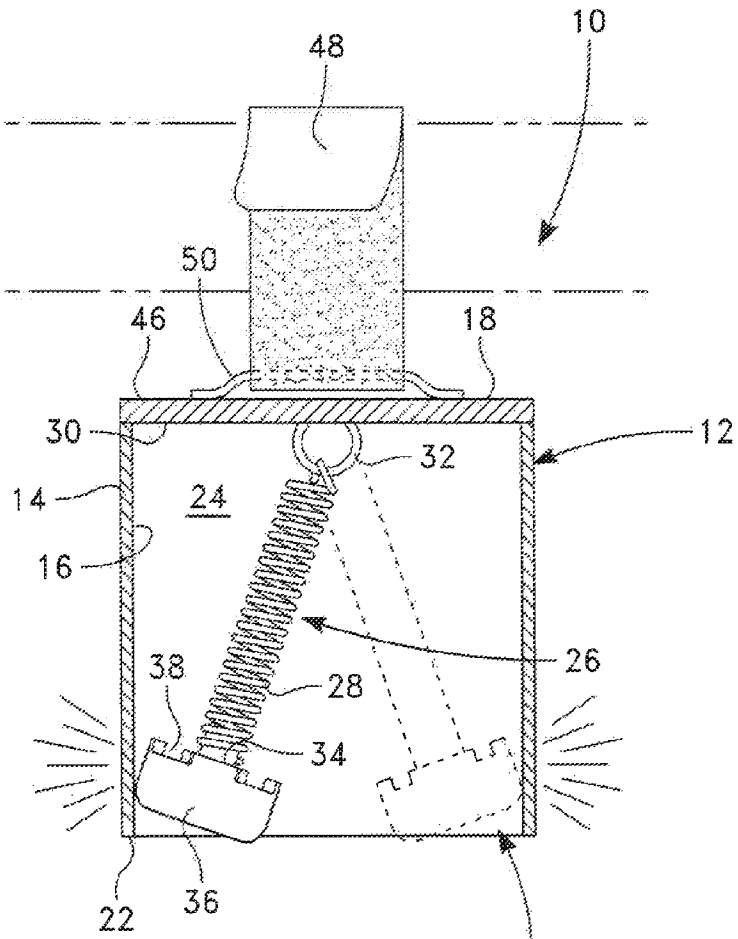
FIG. 7B is a side cross sectional view of the preferred embodiment of the instant invention when the knocker is in the enabled and unlocked position.
Figure 7A:
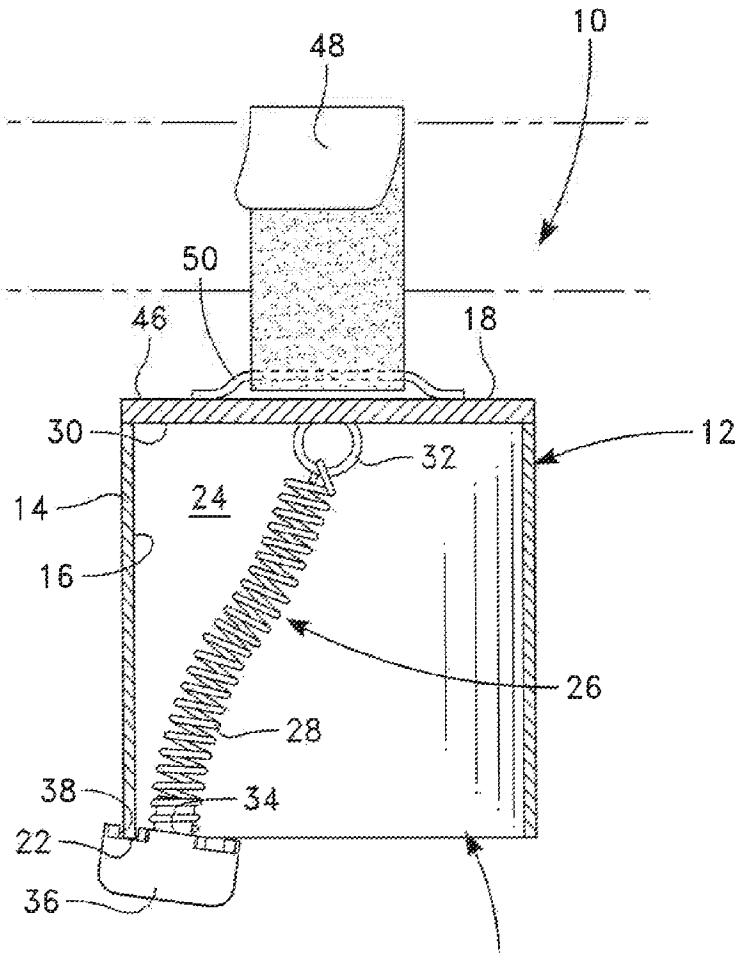
FIG. 7A is a side cross sectional view of the preferred embodiment of the instant invention when the knocker is in the locked and disabled position.
Figure 8:
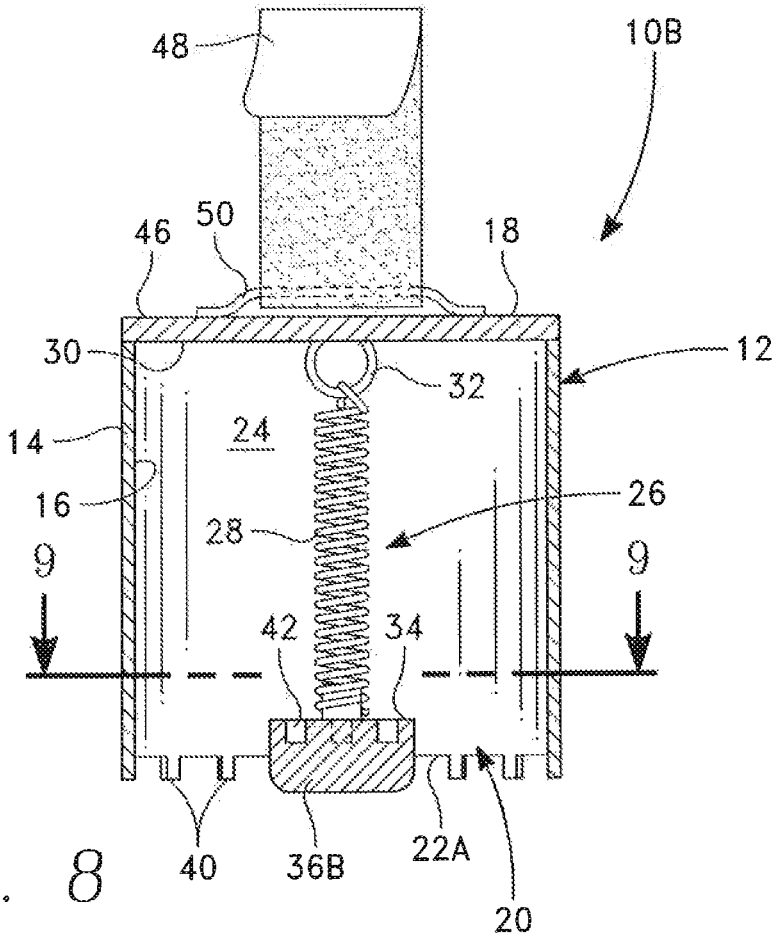
FIG. 8 is a second alternate embodiment of the instant invention.
Figure 9:
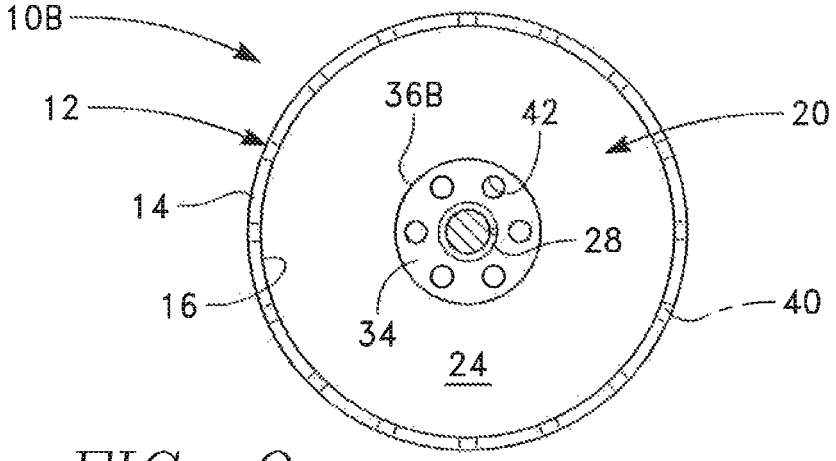
FIG. 9 is a taken along the line 9-9 in FIG. 8.

While in this position, as seen in FIGS. 2 and 7A, the bell 10 will not make any noise because the knocking portion 36 is locked in place on the bottom rim 22 of the main body. To enable use as an alerting bell, the knocker 26 is merely moved away from the bottom perimeter rim 22 of the main body 12 and through the spring 28, it moves back into place inside the interior portion 24 of the main body 12 and is then able to make noise as the cyclist desires.

Figure 4:
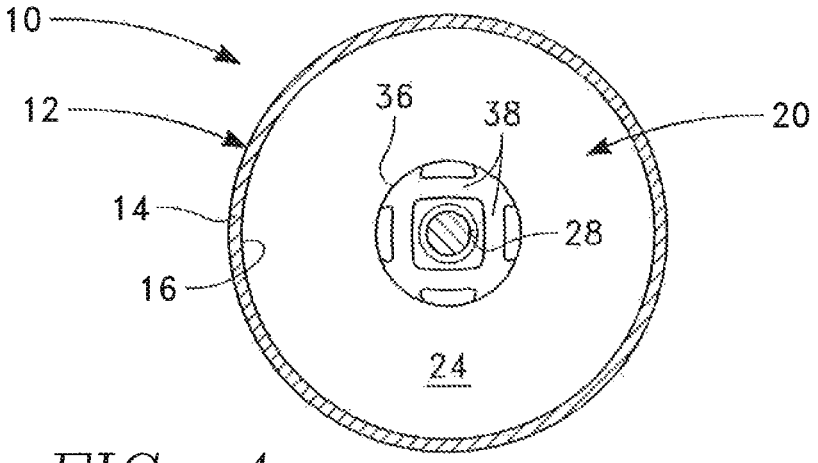
FIG. 4 is taken along line 4-4 in FIG. 3.
Figure 5:
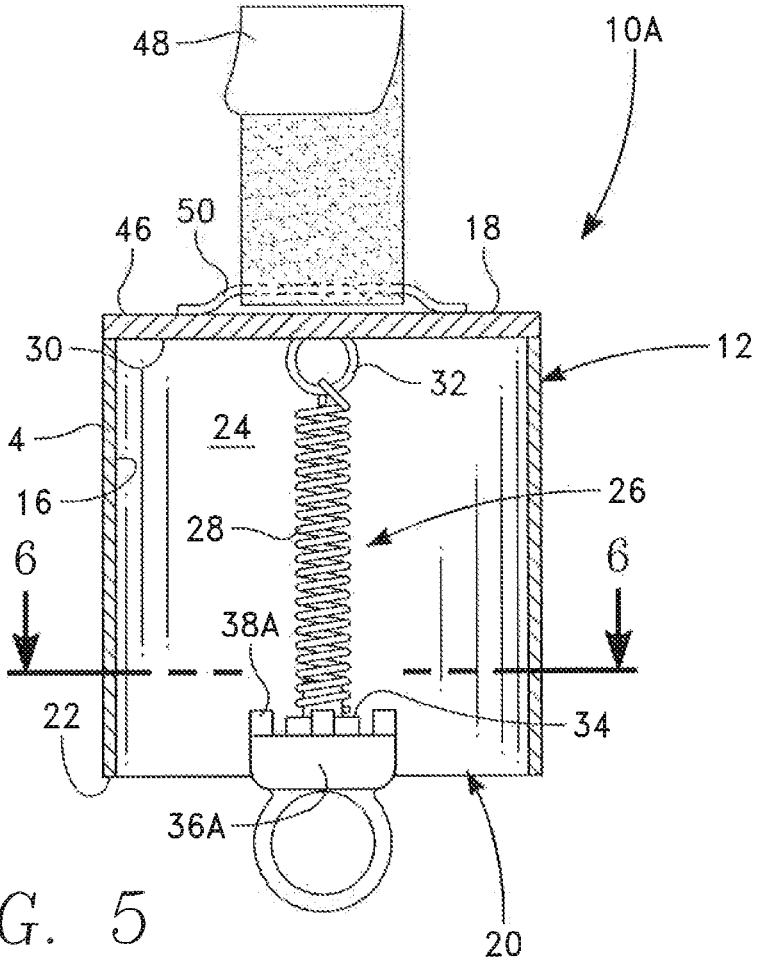
FIG. 5 is a cross sectional side view of an alternate embodiment of the alerting bell of the instant invention.
Figure 6:
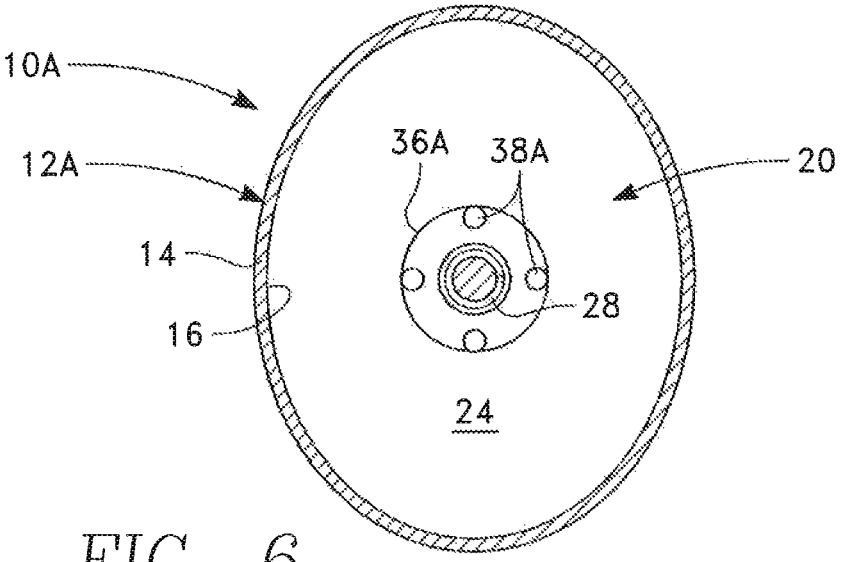
FIG. 6 is taken along line 6-6 in FIG. 5.

While the bell 10 is described as having a main body 12 that is substantially cylindrical in shape, the main body 12 need not be perfectly circular in shape as seen in FIG. 4. Alternatively it could have an elliptical shape as shown in FIG. 6. Additionally, the shape of the flange portions 44 created by the grooves 38 in the knocking portion 36 to be gripped need not have any particular shape. It only matters that there be mating male and female portions found on the knocking portion 26 and the rim of the bottom perimeter 22 that fit with each other to enable activation and deactivation of the knocking portion 36.

The bell 12 includes on the top portion 46 of the closed top 18 a means to fasten the bell 10 to handlebars, backpacks or any other device as desired. The means as illustrated include a hook 42 (FIGS. 3, 5, 7A, 7B and 8) or as a closed strap 50 (FIGS. 1 and 2).

The invention as described in this disclosure can be used any time there is a desire to have a bell as an alert, i.e., hiking, bear alert, dog bell, doorbell, etc. that the user would like to easily be able to turn off. There is also no limitation expressed as to exactly what sort of grooves or means are used to hook the knocker to the outside of the bell to hold it in place. Additionally, any means that would allow the knocker to stretch from its point of connection down the perimeter rim of the bell would serve the same purpose and is contemplated by this disclosure.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A sound alerting device comprising:

a main body substantially cylindrical in shape having a closed top, said closed top having a top and a bottom, an open bottom with a rim perimeter defined thereby and a hollow center portion;

an elongated member having a first end and a second end, said first end being attached to said bottom of said closed top whereby said elongated member moves freely in said interior space and whereby said elongated member is spring loaded thereby allowing said elongated member to extend below said rim perimeter of said open bottom;

a knocking portion of said elongated member attached to said second end of said elongated member wherein when said knocking portion strikes said main body a sound is made and wherein said knocking portion further comprises:

a substantially disc shaped body having a radial perimeter wherein said radial perimeter contains one or more grooves that are attachable to said rim perimeter of said open bottom of said main body as desired thereby disabling the ability of said knocking portion to make a sound.

2. The sound alerting device as defined in claim 1 wherein said rim perimeter of said main body includes a series of substantially evenly spaced grooves.

3. The sound alerting device as defined in claim 2 wherein said radial perimeter of said disc shaped body includes a series of substantially evenly shaped posts whereby said posts fit into said evenly spaced grooves on said rim perimeter of said main body.

4. The sound alerting device as defined in claim 1 wherein a loop is attached to said top of said closed top thereby allowing said sound alerting device to be attached to another article.

5. A method for disabling a sound alerting device comprising:

providing a disable-able sound alerting device, said sound alerting device further comprising:

a main body substantially cylindrical in shape having a closed top, said closed top having a top and a bottom, an open bottom with a rim perimeter defined thereby and a hollow center portion;

an elongated member having a first end and a second end, said first end being attached to said bottom of said closed top whereby said elongated member moves freely in said interior space and whereby said elongated member is spring loaded thereby allowing said elongated member to extend below said rim perimeter of said open bottom;

a knocking portion of said elongated member attached to said second end of said elongated member wherein when said knocking portion strikes said main body a sound is made and wherein said knocking portion further comprises:

a substantially disc shaped body having a radial perimeter wherein said radial perimeter contains one or more grooves that are attachable to said rim perimeter of said open bottom of said main body as desired thereby disabling the ability of said knocking portion to make a sound;

pulling said elongated member below said rim perimeter of said open bottom; and affixing said disc shaped body to said rim perimeter of said open bottom through the mating of said grooves with said rim perimeter of said open bottom.

6. The method as defined in claim 5 wherein said rim perimeter of said main body includes a series of substantially evenly spaced grooves.

7. The method as defined in claim 6 wherein said radial perimeter of said disc shaped body includes a series of substantially evenly shaped posts whereby said posts fit into said evenly spaced grooves on said rim perimeter of said main body.

8. The method as defined in claim 5 wherein a loop is attached to said top of said closed top thereby allowing said sound alerting device to be attached to another article.

* * * * *